United States Patent [19]

Schönmann, Jr.

[11] 4,087,263

[45] May 2, 1978

[54] SEPARATOR SYSTEM FOR STEAM SUPPLIED APPARATUS

[75] Inventor: Fredi Schönmann, Jr., Zurich, Switzerland

[73] Assignee: E. Schonmann & Co., Ag., Zurich, Switzerland

[21] Appl. No.: 765,883

[22] Filed: Feb. 7, 1977

[30] Foreign Application Priority Data

Feb. 9, 1976 Switzerland ..... 1549/76

[51] Int. Cl.[2] ..... B01D 50/00

[52] U.S. Cl. ..... 55/320; 55/327; 55/417; 55/464; 210/305; 210/322

[58] Field of Search ..... 55/319, 320, 327, 417, 55/462–465; 122/488; 210/305, 310, 322

[56] References Cited

U.S. PATENT DOCUMENTS

| | | | |
|---|---|---|---|
| 1,284,793 | 11/1918 | Sharp | 55/417 |
| 1,899,030 | 2/1933 | Gruman | 55/417 |
| 3,676,024 | 7/1972 | Akaiki et al. | 55/327 |

*Primary Examiner*—Bernard Nozick

*Attorney, Agent, or Firm*—Flynn & Frishauf

[57] ABSTRACT

To provide only dry steam to a steam appliance, under controlled conditions, a housing block is formed with steam inlet and outlet flanges or the like, a filter being removably located in the housing immediately behind the inlet and a control valve located in the housing immediately behind the outlet; the housing forms a space between the filter and the control valve to dry admitted steam, including a condensate collecting region at the bottom thereof which terminates in an outwardly accessible drain opening. The drying chamber formed by the housing is separated or subdivided into compartments by at least one impact or deflection plate against which the steam is guided in order to separate the drying chamber into a pre-drying and a post-drying chamber and efficiently remove moisture and water droplets from the steam introduced into the system.

10 Claims, 1 Drawing Figure

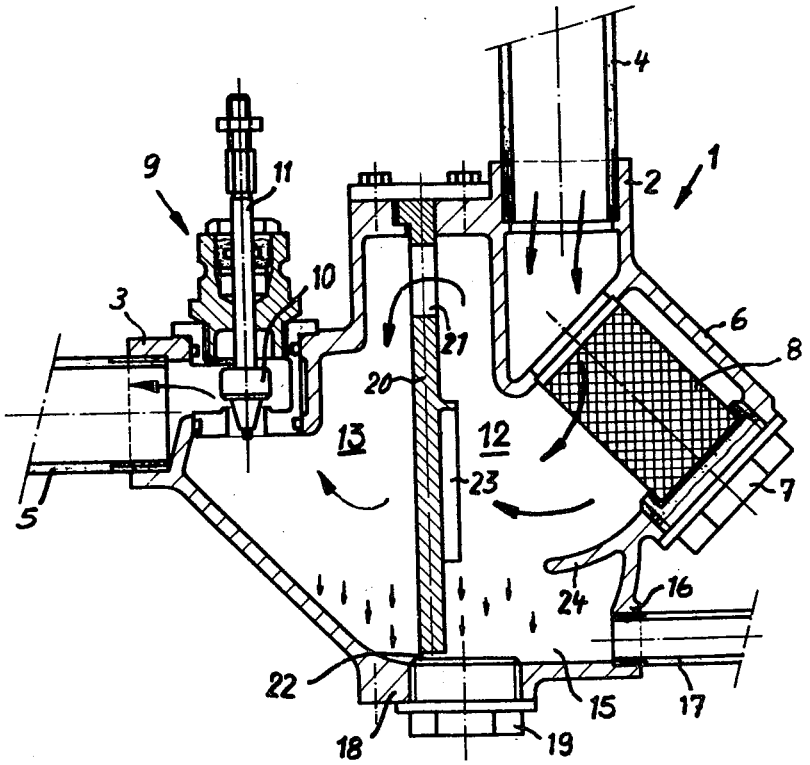
1
2
3
4
5
6
7
8
9
10
11
12
13
15
16
17
18
19
20
21
22
23
24

SEPARATOR SYSTEM FOR STEAM SUPPLIED APPARATUS

The present invention relates to a control system for steam operated devices, such as heating or climate control systems to which steam is supplied under controlled conditions, the steam, when supplied, being essentially dry.

The various elements of such a control system must be located with respect to each other in predetermined relationships and problems arise in so locating the control elements, steam generation stages, cleaners, filters, dryers, condensate collectors, control valves and the like. Frequently, location of the various elements becomes complex and requires piping and ducting, as well as pipe connections which are space-consuming and additionally call for substantial installation and labor costs when connected to the respective steam generators and appliances. Subdividing the various elements of a control system into component parts which are then interconnected additionally leads to inefficiencies in first cost, as well as in operation.

It is an object of the present invention to simplify steam control systems supplying steam to appliances or devices.

SUBJECT MATTER OF THE PRESENT INVENTION

Briefly, a housing block is provided formed with steam inlet and steam outlet stubs or flange connections. In the direction of flow of the steam, a filter body is located immediately behind the steam inlet stub. A control valve is removably located immediately in advance of the steam outlet stub. The space in the housing between the filter and the outlet forms a steam drying chamber. The steam drying chamber, itself, is subdivided into chamber portions by an impingement or impact plate against which the steam is directed. The lower portion of the steam drying chamber forms a condensate collecting zone which is accessible from the outside by means of a condensate removal pipe stub or outlet. The impingement wall separates the drying chamber into portions so that one of them is a pre-drying chamber and the other a post-drying chamber; preferably, the wall is formed with longitudinally extending vanes, ridges, or the like, to assist run-down of vapor or water particles which are projected against the impingement wall.

The housing block can thus support all the necessary control elements as well as the pre-conditioning elements necessary to supply dry steam to an appliance. The overall structure is thus substantially simplified and permits compact arrangement thereof, easy accessibility of the control elements and the treatment elements for service, maintenance or repair, and additionally permits short flow path connections between the steam supply stub and the user or steam outlet stub. The steam paths through which the steam flows, as well as the inclusion of the steam drying zone within the housing which also includes the control valve structure results in high efficiency of the control system.

Preferably, the flow path of the steam is at tortuous or sinuous path formed by locating deflection elements in the path of the flow of the steam after the steam has passed through the filter body. These steam deflection elements are, for example, the impingement or projection wall separating the drying chamber into its two portions or compartments. The impingement wall is formed with the vanes, ridges, or the like, in the region in which steam impinges thereon in order to facilitate precipitation of water droplets carried along by the steam.

DRAWINGS

Illustrating an example:

The single FIGURE is a schematic longitudinal section through a housing block and illustrating the overall system.

The housing block 1 is formed with an upwardly directed steam entry stub 2, for attachment to a steam supply line 4. The steam supply line can be connected to the stub in a suitable manner, for example by a screw connection (as shown), by flanges, or otherwise. The outlet from the housing 1 is an outlet stub 3 to which an appliance or a connecting pipe 5 can be connected, for example again by screw connection as shown, by flanges, or the like.

The steam entry stub 2 terminates in an inclined stub-like element 6 which is integrally part of the housing 1 and externally closed off by a sealing plug 7, or a suitable cover cap. A filter 8 is located within the inclined portion 6. Filter 8 is removable and accessible upon unscrewing plug 7.

A steam control valve 9 is located immediately in advance of the outlet stub 3. The valve 9 is removably, replaceably secured in the housing 1. The valve 9 may be of any suitable construction. In a preferred, and particularly advantageous form, the valve 9 is a control valve having linear control characteristics. Additionally, the valve 9 preferably is so constructed that the movable valve element 10 is secured to a valve spindle 11 which is so shaped that it can be connected to various customary automatic or manually operated drive or positioning control elements.

Housing 1 is arranged to define therein a steam drying chamber. The steam drying chamber is the space between the inlet stub and the immediately adjacent filter 8 or, the inclined portion 6, respectively, and the valve 9 immediately in advance (within the direction of flow of steam) of the outlet stub 3. The steam drying chamber merges into a condensate collecting region 15 which is connected by a laterally extending outlet stub 16 to a condensate return line 17. Condensate return line 17 can be returned to a condenser, to the steam generator, boiler, or the like. A drain plug or cap 19 closes off a drain stub 18, provided to permit access to the condensate collecting region, for example for cleaning.

The steam drying chamber is separated into a pre-drying chamber 12 and a post-drying chamber 13 by an impingement wall 20. Wall 20 extends vertically through the housing 1. The filter body 8 and the region immediately adjacent the inclined zone 6 forms the pre-drying chamber 12. The post-drying chamber 13 is located immediately in advance of the outlet valve 9. The two drying chamber portions are connected by openings 21 located in the upper region of the impingement wall 20. The impingement wall 20 is additionally formed with openings 22 at the lower side thereof in order to provide connection between the two chambers in the region of the condensate collecting zone. The condensate collecting zone is inclined, especially in the region of the post-drying chamber 13 towards the outlet stub 16 in order to provide for gravity flow of the condensate to the outlet thereof.

The wall 20 is additionally formed with longitudinal vanes, ridges or projections 23, located within the range of impingement of the steam thereagainst.

Operation: Usually, steam is applied to the inlet stub 2 at high speed. It will flow through stub 2 first through the filter 8 in which contamination carried along by the steam, particularly solid particles, are filtered out. Such solid particles may be split-off chips, scale, remnants of gaskets, gasket sealing materials, sealing tape, and the like.

After passing through filter 8 in which solid particles are filtered off, the stream of steam reaches the pre-drying chamber 12. The volume of pre-drying chamber 12 is greater than the passage volume of the inlet stub 2, thus causing sudden decrease in flow speed of the steam. The actual flow of the steam is illustrated by the large, heavy arrows. Due to the sudden drop in speed, water and vapor particles which are carried along by the steam are precipitated. The water and vapor particles will drop down into the condensate collecting zone 15, as illustrated by the small arrows in the figure, to be conducted off through the condensate outlet stub 16 and the connected condensate pipe 17. The steam then impinges on the wall 20. Wall 20 deflects the steam upwardly towards the upward opening 21. The region in which the opening 21 is located is constricted, thus causing acceleration of flow. The ridges or vanes 23 on wall 20 additionally contribute to precipitation of water particles, which will adhere to the extended surface of the wall 20 to drop off into the condensate collecting zone 15. Steam deflection guide surfaces 24 are preferably formed between the filter 8 and the wall 20 in order to effectively direct the steam against the wall 20 and, especially, against the extended surface formed by the vanes 23.

The steam, accelerated due to the constricted flow opening 21, and the constricted immediate flow region adjacent thereto can again expand in the post-drying chamber 20. The water precipitation process will repeat; the still remaining water droplets are precipitated and dropped off, as shown by the small arrows, and can flow through opening 22 and the inclined lower surface to the outlet stub 16.

The structure and system thus provide for cleaning of the steam and drying the steam in three steps, by the physical process in the pre-drying chamber 12, by the mechanical process by mechanical impingement against wall 20, and by the physical process in the post-drying chamber 13. The control valve 9 thus can control application of steam of high quality to the outlet stub 3, and hence to the connected appliance, schematically indicated by connecting duct 5.

Various changes and modifications may be made; the particular shape of the housing is not critical, but the shape as shown is preferred. It can, however, be constructed to be more elongated. The filter 8 need not necessarily as shown; it can be in form of a labyrinth. More than one impingement wall 20 can be provided, so that the steam drying chamber is subdivided into more than two regions. Filter material or labyrinth paths can be included in the connecting openings or ducts, like duct 21, communicating one zone with the next.

I claim;

1. Control system for steam supplied apparatus, particularly to supply dry steam thereto from a supply comprising a housing block (1) and defining therein a steam drying chamber (12, 13);

a steam inlet means (2) communicating with the interior of the housing;

a steam outlet means (3) communicating with the interior of the housing and providing for removal of dried steam therefrom;

a filter (8) removably located in the housing immediately behind the steam inlet means (2);

a control valve (9) removably located in the housing immediately in advance of the outlet means (3);

an impingement wall (20) subdividing the steam drying chamber into a pre-drying chamber (12) and a post-drying chamber (13), the pre-drying chamber being adjacent the filter (8) and the post-drying chamber being adjacent the valve (9);

means (21) forming a steam communication between the pre-drying and post-drying chambers (12, 13);

and a condensate collecting zone (15) located at the bottom portion of the housing including a condensate outlet duct (16) and in fluid communication with at least said pre-drying chamber.

2. System according to claim 1, wherein the housing is formed with an inclined portion (6) located immediately adjacent to the inlet stub (2), said filter (8) being located in said inclined portion (6).

3. System according to claim 1, further including a cleaning outlet stub (18) formed in the housing and communicating with the condensate collecting zone (15) to provide exterior access thereto.

4. System according to claim 1, wherein the botton wall of at least the post-drying chamber is inclined with respect to the condensate outlet (16).

5. System according to claim 1, where the means communicating between said chamber portions (12, 13) comprises an opening (21) located in the upper region of the wall (20) to permit passage of steam from the pre-drying chamber (12) to the post-drying chamber (13).

6. System according to claim 5, further comprising means forming a zone of restricted cross section, having a cross-sectional area which is small with respect to the cross section of said pre-drying chamber (12) to accelerate the flow of steam through said opening (21).

7. System according to claim 1, further including steam flow path guide means (24) located between the filter (8) and the impingement wall (20) and guiding the flow of steam to direct the steam from the filter to impinge on said wall (20).

8. System according to claim 7, wherein the wall is formed, in the zone of impingement by the steam, with a region of increased surface area.

9. System according to claim 8, wherein the region of increased surface area comprises projections (23) projecting from the major surface of the wall (20) to assist in precipitation of water droplets from the steam impinging against said surface area of the wall (20).

10. System according to claim 9, wherein the means communicating between said chamber portions (12, 13) comprises an opening (21) located in the upper region of the wall (20) to permit passage of steam from the pre-drying chamber (12) to the post-drying chamber (13);

the housing is formed with an inclined portion (6) located immediately adjacent the inlet stub (2), said filter (8) being located in said inclined portion (6);

and wherein the bottom wall of at least the post-drying chamber is inclined with respect to the condensate outlet (16).

* * * * *